US005704755A

United States Patent [19]

Jesperson

[11] Patent Number: 5,704,755

[45] Date of Patent: Jan. 6, 1998

[54] PANEL LIFTING HOISTS

[75] Inventor: Thomas Francis Jesperson, Caloundra, Australia

[73] Assignee: Plasterboard Lifting Tools Pty Ltd., Queensland, Australia

[21] Appl. No.: 481,301

[22] PCT Filed: Jan. 4, 1994

[86] PCT No.: PCT/AU94/00004

§ 371 Date: Aug. 7, 1995

§ 102(e) Date: Aug. 7, 1995

[87] PCT Pub. No.: WO94/15870

PCT Pub. Date: Jul. 21, 1994

[30] Foreign Application Priority Data

Jan. 5, 1993 [AU] Australia ..... PL6677

[51] Int. Cl.[6] ..... E04G 21/14

[52] U.S. Cl. ..... 414/11; 414/10; 414/607

[58] Field of Search ..... 414/10, 11, 598, 414/607, 621, 668

[56] References Cited

U.S. PATENT DOCUMENTS

| | | | |
|---|---|---|---|
| 2,815,132 | 12/1957 | Stone | 414/11 |
| 2,828,870 | 4/1958 | Corley | 414/11 |
| 2,939,590 | 6/1960 | Henry | 414/11 |
| 3,019,914 | 2/1962 | Taylor | 414/11 |
| 3,305,219 | 2/1967 | Rhodes | 414/11 |
| 3,643,935 | 2/1972 | Bell | 414/10 |
| 4,749,324 | 6/1988 | Rulison | 414/10 |
| 4,810,151 | 3/1989 | Shern | 414/11 |
| 5,224,808 | 7/1993 | Macris | 414/11 |

*Primary Examiner*—Karen B. Merritt
*Assistant Examiner*—Douglas Hess
*Attorney, Agent, or Firm*—Helfgott & Karas, P.C.

[57] ABSTRACT

There is provided a panel lifting apparatus for detachable attachment to a panel lifting hoist or trolley. The apparatus comprises a primary support member, a clamp for gripping engagement with a panel to be lifted, a control device for actuating the clamp via a cable linking the clamp and the control device. When a panel is to be lifted from a position off the apparatus and onto the hoist or trolley, the clamp is brought into engagement with the panel and the control device is actuated to draw the panel onto the hoist or trolley enabling the support and carriage of same.

19 Claims, 7 Drawing Sheets

FIG. 2

PANEL LIFTING HOISTS

BACKGROUND OF THE INVENTION

The present invention relates to hoists but more particularly relates to mobile hoists for lifting wall and/or ceiling panels used in building construction.

Most buildings are constructed utilizing available forms of cladding for internal walls, which cladding generally comprises flat sheets or panels of various dimensional sizes and weights. Ceilings and internal walls are generally lined with these panels. Where large panels are used, the weight of those sheets makes fixation thereof at least a two and preferably a three man job. The panels are heavy, cumbersome and hard to handle especially where panels are to be placed on the ceiling.

Wallboard panels made from plaster and cardboard are not stiff enough to resist bending and must be carefully handled so that they are kept substantially flat during installation to prevent snapping. For long panels this necessitates adequate support of the panels until they are fixed in position.

In recognition of this problem, special hoists have been constructed for handling panels such as wallboards. One such hoist is the subject of U.S. Pat. No. 3,828,942.

That invention comprises a lifting device for lifting ceiling panels into place flush against the ceiling beams for installation. The device has a supporting structure for supporting the panel and telescopic sleeves for raising and lowering the panels. The device also has a cable and pulley connecting structure for telescoping the sleeves with a drum or spool for winding the cable and a brake mechanism for the drum. The supporting structure may also be pivoted at an angle and carry thereon panels for installation against the upright wall framework.

More particularly, that invention comprises a lifting device for lifting and aligning wallboard panels to and with the ceiling and vertical walls for installation of the panels to the interior frame of a building. The device comprises a telescopic shaft or sleeve structure, an upright frame, a drum mounted to the upright frame having a wheel for rotating the drum, a plurality of pulleys mounted to the telescopic structure and frame, a cable extending from the drum and about the pulleys and interconnecting the telescoping shaft structure whereby rotation of the drum in one direction by turning the wheel will telescope the telescopic shaft structure. Spaced apart support beams are mounted to the upper end of the telescopic shaft structure each of which have hooks at one end whereby a panel may be placed upon the support beams retained by the hooks and raised vertically to the ceiling by the telescopic structure. The support structure may be pivoted to a selected angle whereby the panel rests in the hooks. The device can then be moved toward a vertical wall framework to facilitate placement of the panel in position against the vertical wall for installation of the panel.

One disadvantage of this device is that the user is still required to lift the wall and ceiling panels onto the device itself. Once the panel is lifted by hand onto the device, the device is operated in the usual way by hoisting the ceiling or wall panel into position. It is quite difficult for one individual to lift heavy panels onto the hoist. Using the existing hoist it is still generally a two man job.

SUMMARY OF THE INVENTION

The present invention seeks to overcome this problem by providing a panel lifting and transporting assembly which enables a panel to be lifted from a position off the assembly to a support structure on the assembly.

More particularly the present invention provides an assembly including a panel lifting apparatus for attachment to a panel hoist or panel support trolley thereby providing means to enable lifting of a panel to be fixed to the surface of a building onto the hoist.

The attachment comprises:

means for enabling attachment of the apparatus to a supporting hoist or trolley, clamping means for gripping a panel to be lifted;

control means directly or indirectly linked to the clamp to enable movement/lifting of the panel onto the hoist. Preferably, the attachment is detachable from the hoist and also foldable.

In one broad form the present invention comprises;

a panel lifting assembly including an apparatus for use with a panel lifting hoist or trolley for transferring a panel from an off the hoist or trolley location onto the hoist or trolley in preparation for lifting of said panel to the point of fixation;

the apparatus comprising;

means to enable releasable attachment of the apparatus from the hoist or trolley, clamp means for grippingly engaging a panel to be lifted;

control means for moving the panel to be lifted from an off assembly location to an on assembly location.

Preferably the attachment apparatus is foldable and is used with an adapter with a connecting saddle which receives a wedge plate on the apparatus.

In another form of the invention, the attachment previously described is mounted on its own supporting trolley enabling carriage and transport of panels.

In its broadest form, the present invention comprises:

a panel lifting assembly comprising;

a panel support hoist or trolley having at least a ground engaging carriage and a support structure, a panel lifting apparatus having means to enable detachable attachment of the apparatus to and from the hoist or trolley;

characterized in that the panel lifting apparatus comprises;

a primary support member, a clamp for gripping engagement with a panel to be lifted, control means for actuating the clamp via a cable which links the clamp and the control means;

wherein when a panel is to be lifted from a position off the assembly and onto the assembly, the clamp is brought into engagement with the panel and the control means actuated to draw the panel onto the assembly enabling support and carriage thereof.

In another form the present invention comprises;

a panel lifting apparatus for detachable attachment to a panel lifting hoist or trolley the apparatus comprising;

a primary support member, a clamp for gripping engagement with a panel to be lifted, control means for actuating the clamp via a cable linking the clamp and the control means;

wherein when a panel is to be lifted from a position off the assembly and onto the hoist or trolley, the clamp is brought into engagement with the panel and the control means actuated to draw the panel onto the hoist or trolley enabling support and carriage thereof.

In another form the present invention comprises:

a panel lifting trolley of the type comprising a ground engaging carriage, a substantially upright mainframe, a panel support platform connected to the mainframe and capable of being tilted characterised in that the panel support platform has thereon a saddle which detachably receives a wedge plate on a panel lifting apparatus which locates on the support platform; further characterised in that the panel lifting apparatus comprises;

a primary support member, a clamp for gripping engagement with a panel to be lifted, control means for actuating the clamp via a cable linking the clamp and the control means;

wherein when a panel is to be lifted from a position off the trolley and onto the trolley, the clamp is brought into engagement with the panel and the control means actuated to draw the panel onto the trolley enabling support and carriage thereof.

BRIEF DESCRIPTION OF THE DRAWINGS

The invention will now be described in more detail and in each of its forms according to preferred but non limiting embodiments and with reference to the accompanying illustrations wherein.

DESCRIPTION OF THE PREFERRED EMBODIMENTS

Figure 1:
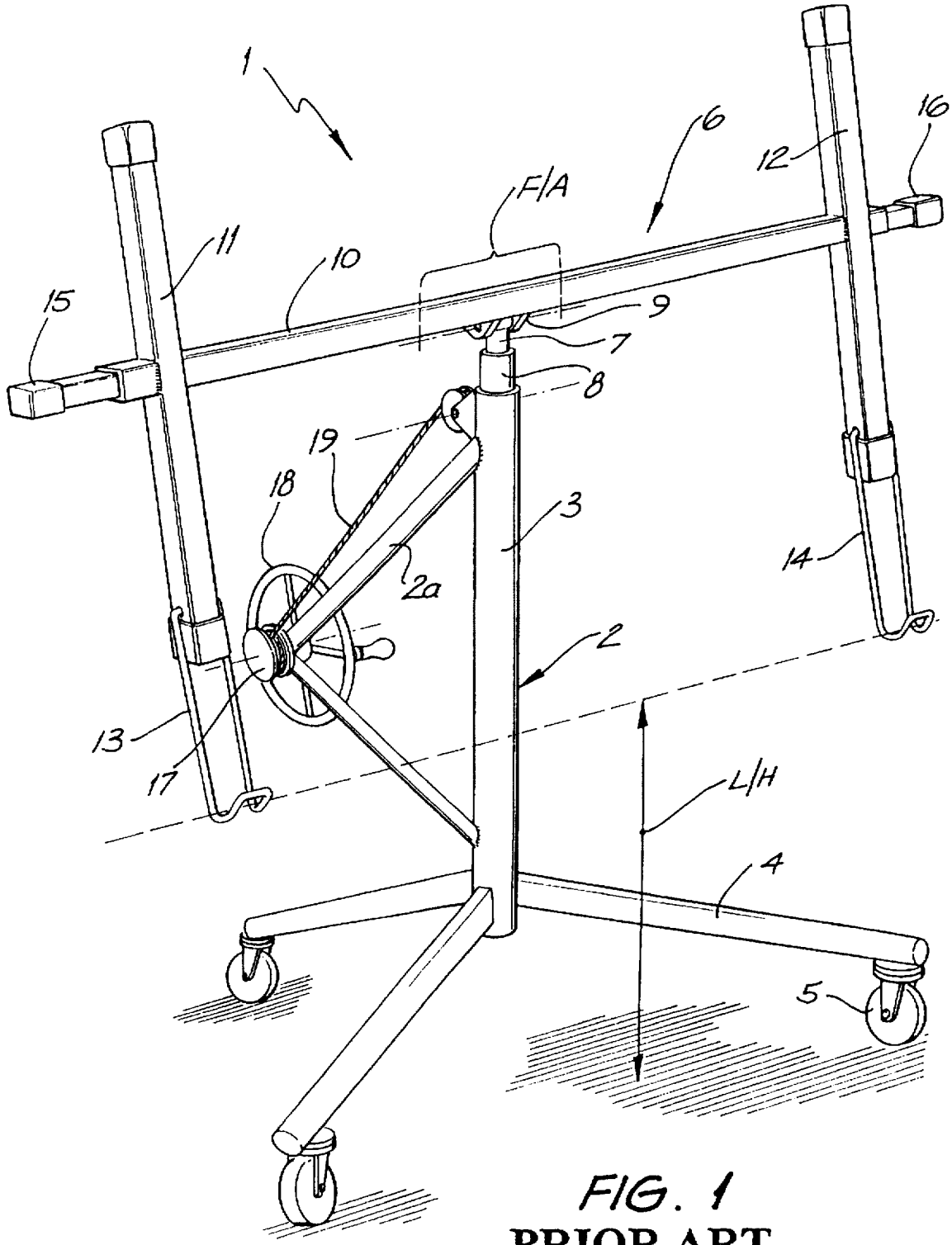
FIG. 1 PRIOR ART
FIG. 1 shows a prior art hoist.

Referring to FIG. 1 there is shown a known prior art panel lifting hoist 1. The hoist 1 comprises an upright mainframe 2 which comprises a telescopic sleeve structure 3 and splayed legs 4. The upright mainframe supports generally H-shaped platform 6 which is used for supporting a panel (usually a wall or ceiling panel) and placing that panel at the location at which it is to be affixed. The H-shaped panel support platform 6 may be elevated by means of telescopic members 7 and 8. Connecting the upright main frame to the H-shaped platform 6 is pivot 9 which allows the platform 6 to be rotated so that the panel carried by the platform can be presented at the correct attitude for fixing. Thus, the platform 6 can be disposed so that panels for fixing to walls can be presented directly to the wall or alternatively platform 6 can be rotated to a substantially horizontal attitude so that it presents a panel facing a ceiling. Platform 6 generally comprises a longitudinal beam 10 and transverse arms 11 and 12. The transverse arms 11 and 12 have at one end of each arm saddles 13 and 14. The H-shaped member also has extension arms 15 and 16 to enable an increase in the length of the support platform for larger panels. With this platform configuration panels of most, if not all, sizes can be supported on the platform.

Upright main frame 2 is also adapted with support frame 2*a* which supports cable drum 17 and drive wheel 18. When the panel support platform 6 is to be elevated the drive wheel 18 is rotated causing cable 19 to elevate H-shaped panel support platform 6 via telescopic members 7 and 8.

The main disadvantage of the above described prior art panel lifting hoist is that it is necessary for a user to lift a panel from the floor and onto the platform. Wall and ceiling panels are often large and difficult for an individual to manage thus making it inconvenient for one person to constantly be lifting heavy panels onto the hoist.

Figure 2:
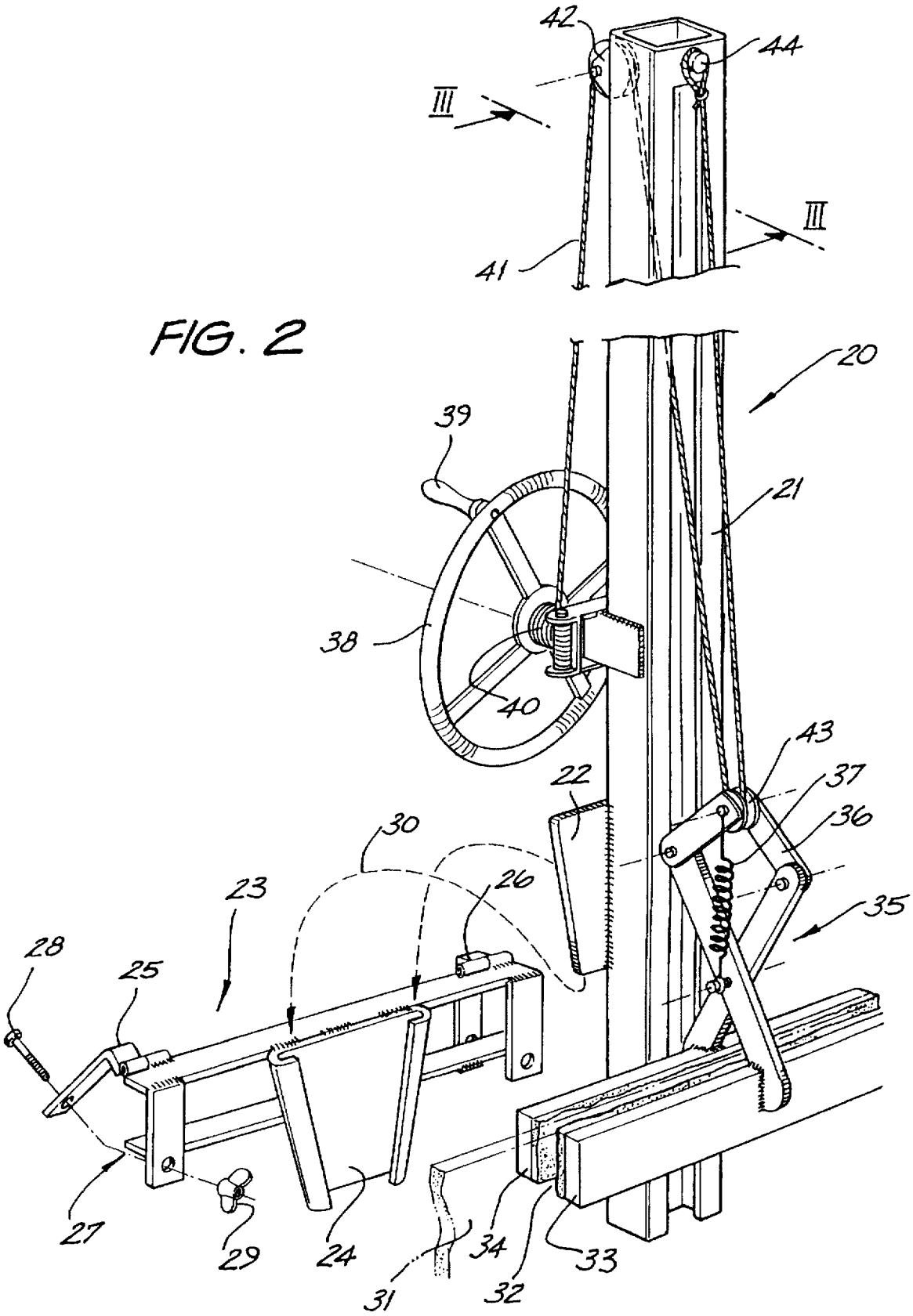
FIG. 2 shows an isometric view of the panel lifting apparatus according to one form of the present invention.

Referring to FIG. 2 there is shown a panel lifting apparatus 20 which is an improvement on the prior art hoist and may be used on its own or in conjunction with other means of support such as a trolley (see FIGS. 4 and 5) or, alternatively, may be used as an attachment to a modified trolley (See FIG. 6) or to an existing hoist an embodiment of which has been previously described with reference to FIG. 1.

Panel lifting apparatus 20 comprises a support column 21 of indefinite length. This column may be varied in height/length according to particular requirements. Column 21 is adapted with a wedge plate 22 which engages with tapered saddle 24 on adaptor 23. The adaptor 23 is equipped to enable attachment to the typical prior art hoist as shown in FIG. 1 or to the trolley shown in FIG. 6. The attachment typically takes place by affixing the adapter 23 to longitudinal arm 10 of the prior art hoist by means of hinged posts 25 and 26. Adapter 23 is placed over the longitudinal arm 10 on release of the hinged post 25 and 26 and these are then secured by means of bolts and wing nuts 28 and 29 respectively.

In use, the hoist assembly 20 is connected to saddle 24 via wedge plate 22 as shown by the arrows 30. In use, a panel 31 is gripped in recess 32 by jaws 33 and 34 of clamping assembly 35. The clamping assembly 35 is also equipped with a pantograph 36 which operates the jaws under the assistance of spring bias 37.

When a panel is to be lifted by the jaws, the clamping assembly can be brought down to engage with a panel for instance, lying on the floor and it can be connected with very little effort by the operator. Once the jaws are clamped to the panel by exerting tension on cable 41 on turning of wheel 38 the operator can then start to draw the panel up the column 21 by further operating drive wheel 38 via handle 39. The drive wheel 38 is associated with cable drum 40 around which travels cable 41. The cable travels via pulley 42 and pulley 43 and finally terminates at cable anchorage 44. With this arrangement a simple turning of the drive wheel urges clamping assembly 35 up the support column 21 thereby drawing the panel up and along the column 21. When the hoist assembly 20 is attached to the prior art panel lifting hoist 1 the H-shaped frame can be rotated in the usual manner to orient the sheet in the correct attitude for presentation to the surface to which the panel is to be fixed.

Figure 3:
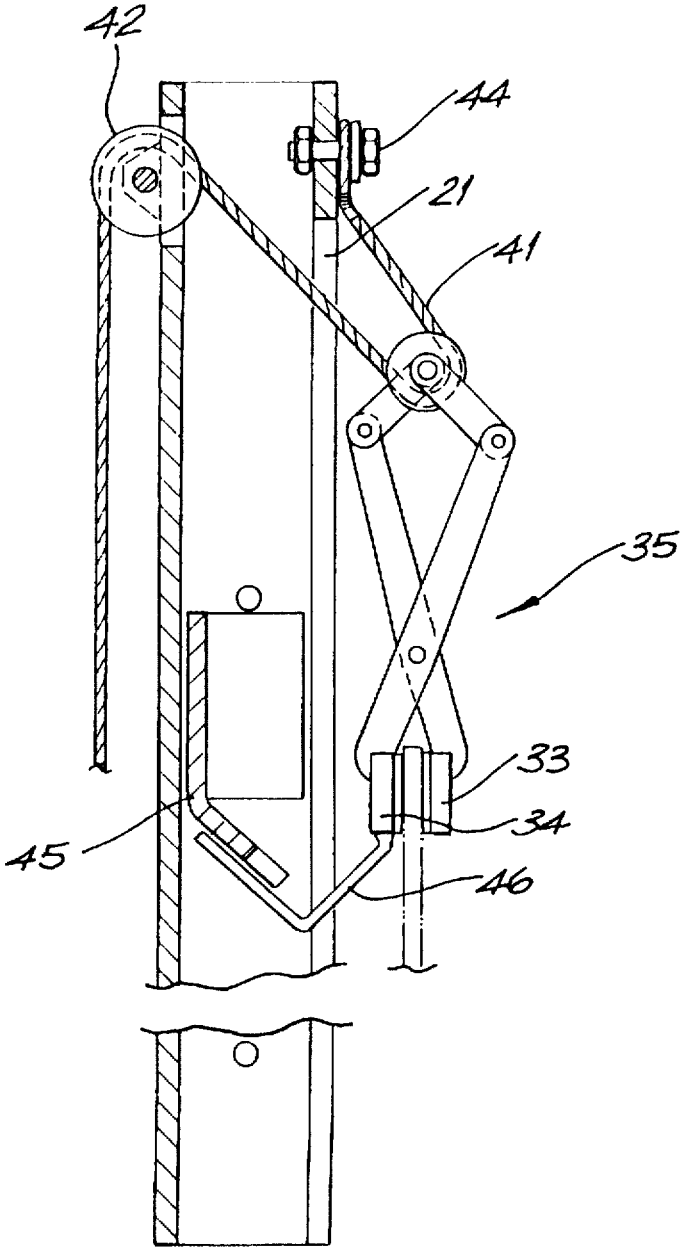
FIG. 3 shows a cross sectional elevational view of the upper part of the apparatus of FIG. 1.

Referring to FIG. 3 there is shown a side elevational cross sectional view of a portion of the panel lifting apparatus of FIG. 2. From this view it can be seen that the column has disposed therein a stop 45 which engages with an arresting arm 46 which is in turn attached to jaw 34. The stop has the effect of arresting the movement of the clamping assembly 35 when it has reached its maximum allowable travel.

Figure 4:
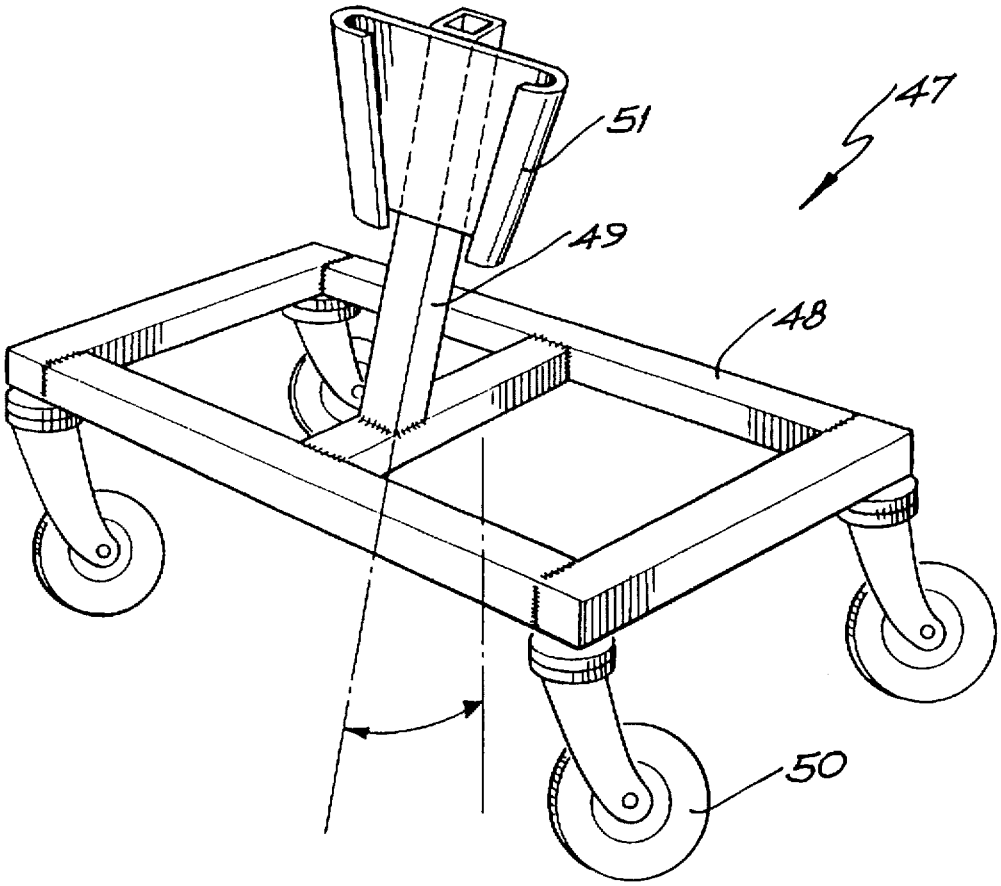
FIG. 4 shows a carriage trolley adapted to receive the apparatus of FIG. 2.

Referring to FIG. 4 there is shown a trolley 47 having a ground engaging main frame 48 and support column 49. The main frame 48 is supported on castors 50. Support column 49 has a tapered saddle configured similar to the adaptor 23 shown in FIG. 2. The panel lifting apparatus 20 as shown in FIG. 2 can be inserted into the tapered saddle 51. Thus, wedge plate 22 may be inserted into saddle 51 shown in FIG. 4. In this way a panel may be lifted from a floor surface or from an attitude leaning against the wall and may be transported around the room to a different location without an operator having to lift the panel.

Figure 5:
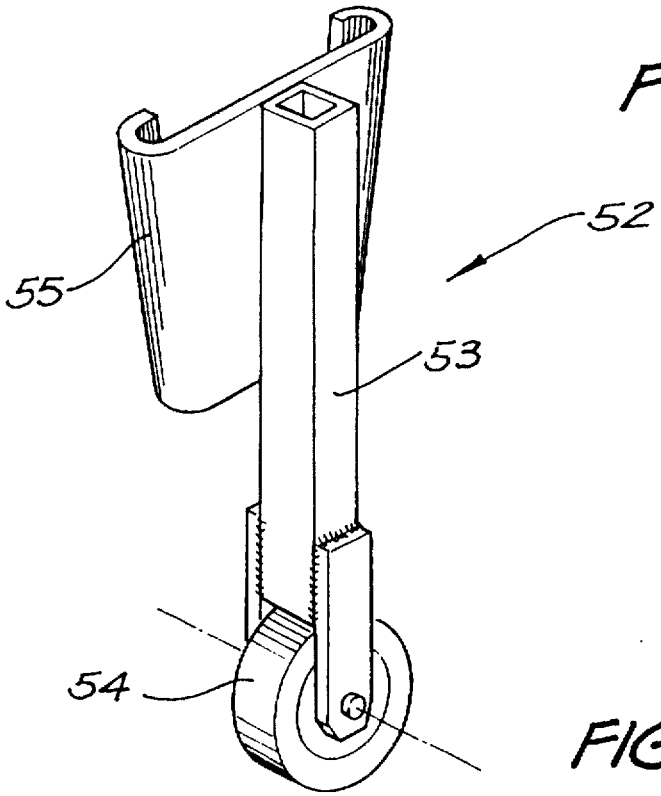
FIG. 5 shows an alternative carriage to that shown in FIG. 4.

FIG. 5 shows an alternative carriage 52 comprising a single support column 53 and castor wheel 54. The support column is adapted with tapered saddle 55 which receives wedge plate 22 of the panel lifting apparatus 20. The assemblies of FIGS. 4 and 5 may be used for transportation of a panel. The weight of the panel when in the clamping assembly 35 as shown in FIG. 2 increases the gripping force against the panel thereby ensuring safety during lifting.

Figure 6:
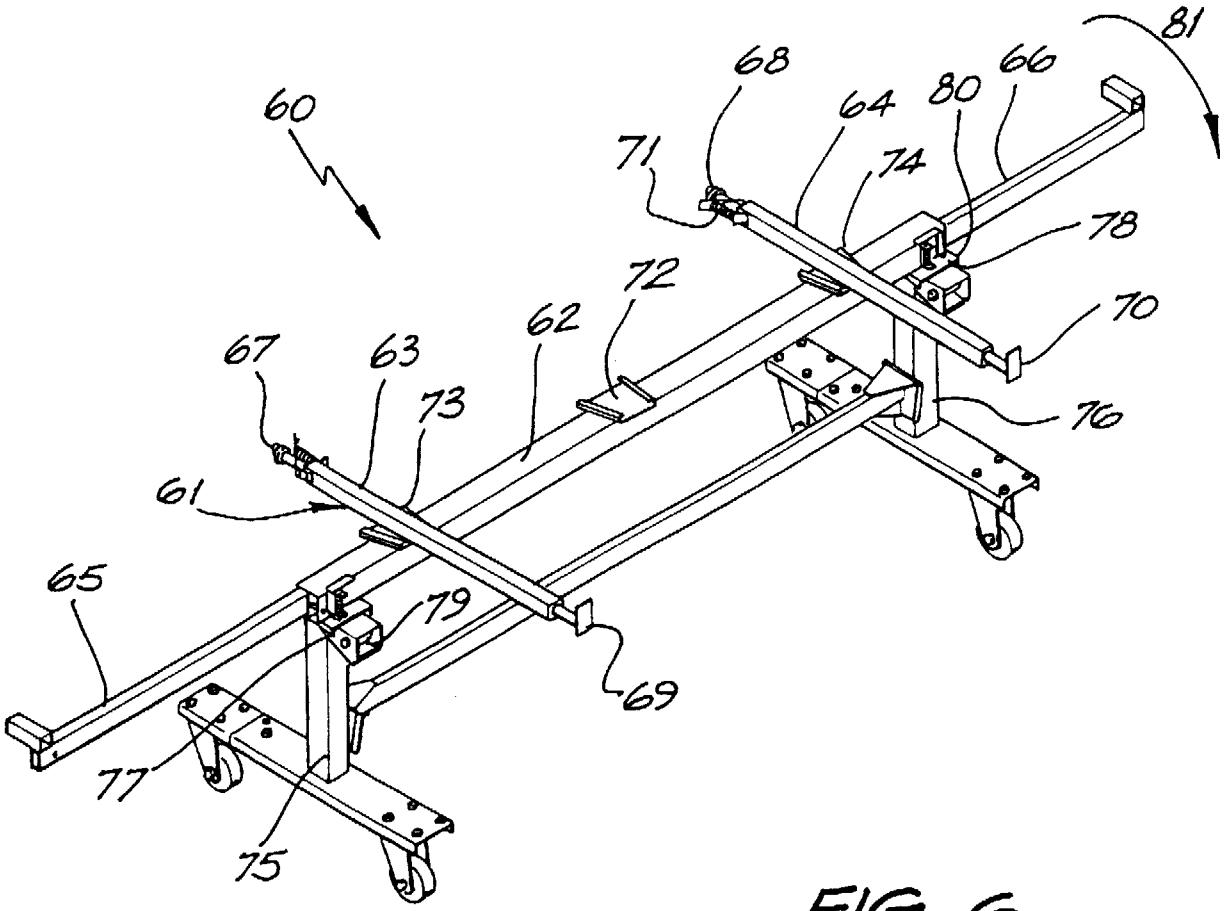
FIG. 6 shows an isometric view of a trolley adapted to receive the apparatus of FIG. 2.

Referring to FIG. 6 there is shown an isometric view of a trolley 60 for use with the panel lifting apparatus 20 shown in FIG. 2.

The trolley comprises a panel support platform 61 which comprises a longitudinal beam 62 and transverse arms 63 and 64. Both the beam 62 has telescopic extension arms 65, 66.

Transverse arms 63 and 64 have knobs 67, 68 which can be turned to allow saddle arms 69 and 70 to also turn to allow a panel of wallboard to be lowered by depressing spring clip 71.

The panel lifting apparatus of FIG. 2 may be connected to the trolley via saddle 72.

The transverse arms 63 and 64 are connected to longitudinal beam 62 via additional saddles 73 and 74.

Likewise the longitudinal beam 62 is connected to supporting legs 75 and 76 via saddles 77 and 78. The saddles 77 and 78 wedge onto hinges 79 and 80.

The hinges enable rotation of the platform 61 in the direction of arrow 81.

Figure 7:
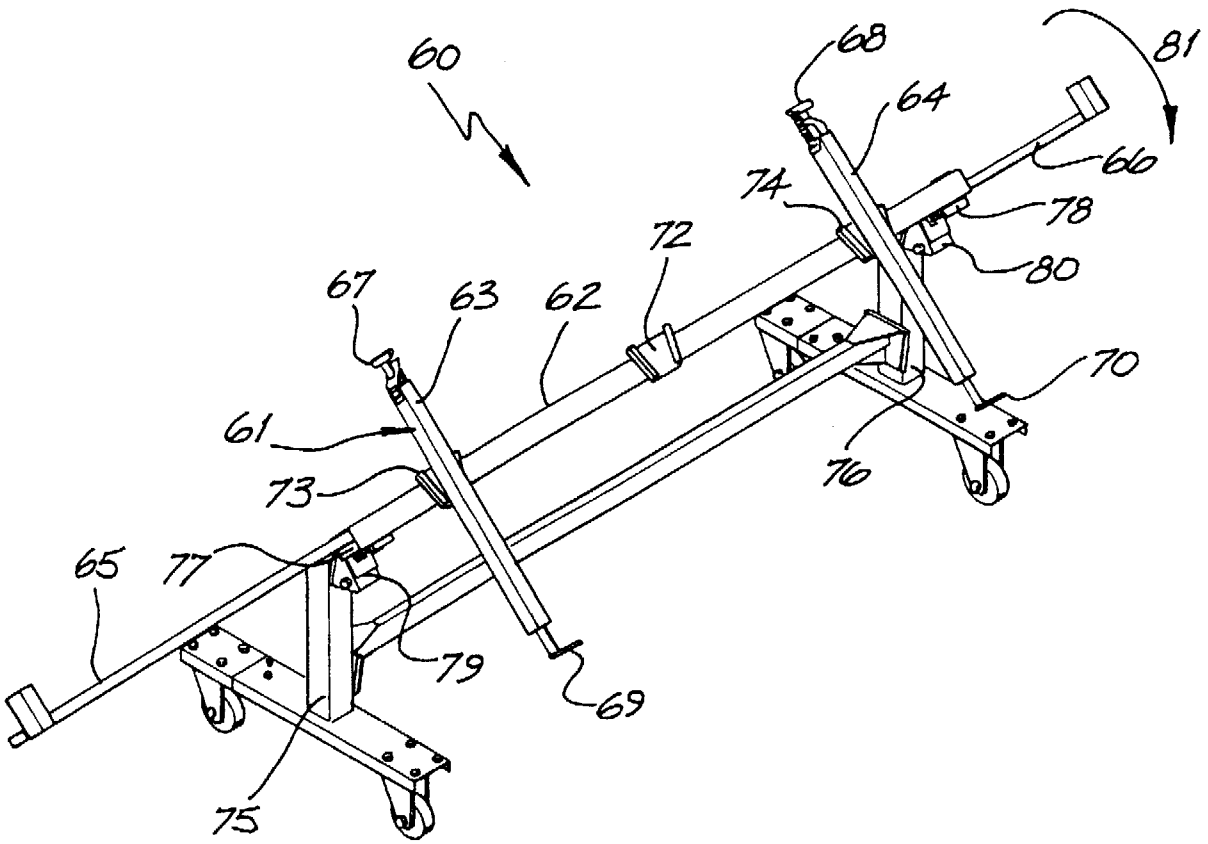
FIG. 7 shows the trolley of FIG. 6 with the panel support platform rotated.

FIG. 7 shows the trolley of FIG. 6 rotated in the direction of arrow 81.

Figure 8:
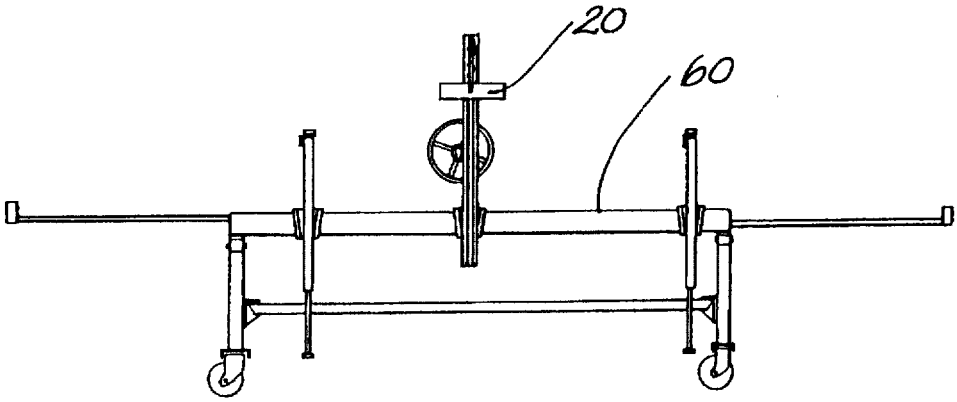
FIG. 8 shows a front elevational view of the trolley of FIG. 6 with the apparatus of FIG. 2 fitted.

FIG. 8 shows a front elevational view of the trolley shown in FIG. 6 this time with the panel lifting apparatus shown in FIG. 2 fitted thereto.

The panel lifting apparatus according to one aspect of the present invention may in addition to its use as an attachment to a prior art hoist assembly be used for lifting sheets over considerable heights for instance from lower floors to upper floors in buildings along outside walls. Alternatively, the jaws may be used with a short piece of cable as a convenient hand tool for carrying panels.

It will be recognized by persons skilled in the art that numerous variations and modifications may be made to the present invention without departing from the overall spirit and scope of the invention as broadly described herein.

The claims defining the invention are as follows:

1. A panel lifting apparatus for detachable attachment to a panel lifting hoist or trolley, the apparatus comprising:

a primary support member;

a wedge-shaped plate extending from the support member which engages a saddle included on the panel lifting hoist or trolley, thereby providing the detachable attachment to the trolley or hoist, a clamp for gripping engagement with a panel to be lifted, control means for actuating the clamp via a cable linking the clamp and the control means;

wherein when a panel is to be lifted from a position off of an assembly comprising the panel lifting hoist or trolley and the panel lifting apparatus and onto the hoist or trolley, the clamp is brought into engagement with the panel and the control means actuated to draw the panel onto the hoist or trolley enabling support and carriage thereof.

2. A panel lifting apparatus according to claim 1 wherein the clamp is a scissor clamp comprising jaws and a pantograph which act in response to actuation of the control means such that the greater the panel load the greater the clamping force.

3. A panel lifting apparatus according to claim 2 wherein the control means comprises a drive wheel having associated therewith the cable linked via at least one pulley with the scissor clamp.

4. A panel lifting apparatus according to claim 3 wherein the primary support member comprises a column.

5. A panel lifting apparatus for detachable attachment to a panel lifting hoist or trolley, the apparatus comprising:

a primary support member, a clamp for gripping engagement with a panel to be lifted, control means for actuating the clamp via a cable linking the clamp and the control means;

wherein when a panel is to be lifted from a position off of an assembly comprising the panel lifting hoist or trolley and the panel lifting apparatus and onto the hoist or trolley, the clamp is brought into engagement with the panel and the control means actuated to draw the panel onto the hoist or trolley enabling support and carriage thereof, wherein the clamp is a scissor clamp comprising jaws and a pantograph which act in response to actuation of the control means such that the greater the panel load the greater the clamping force, and wherein the control means comprises a drive wheel having associated therewith the cable linked via at least one pulley with the scissor clamp, and wherein the primary support member comprises a column to which is attached a wedge plate which provides said detachable attachment to the hoist or trolley, and wherein the cable is anchored at one end on the column and travels via the clamp and said at least one pulley to an anchorage at its opposite end on or near the drive wheel.

6. A panel lifting apparatus according to claim 5 wherein the drive wheel is mounted on an axle which is supported by an axle support structure affixed to the column.

7. A panel lifting apparatus according to claim 6 further comprising an adaptor to facilitate fitting of the panel lifting apparatus to said hoist or trolley; the adapter comprising a clamp and a saddle for receiving said wedge plate.

8. A panel lifting apparatus according to claim 7 wherein the scissor clamp is naturally biased by a spring to a clamped position.

9. A panel lifting apparatus according to claim 8 wherein the column is hollow and includes a stop in the hollow portion to restrict travel of the clamp.

10. A panel lifting assembly comprising;

a panel support hoist or trolley having at least a ground engaging carriage and a support structure, a panel lifting apparatus having means to enable detachable attachment of the apparatus to and from the hoist or trolley;

characterised in that the panel lifting apparatus comprises;

a primary support member, a wedge-shaped plate extending from the support member which engages a saddle included on the panel lifting hoist or trolley, thereby providing the detachable attachment to the trolley or hoist, a clamp for gripping engagement with a panel to be lifted, control means for actuating the clamp via a cable linking the clamp and the control means;

wherein when a panel is to be lifted from a position off of the assembly and onto the assembly, the clamp is brought into engagement with the panel and the control means actuated to draw the panel onto the assembly enabling support and carriage thereof.

11. A panel lifting assembly according to claim 10 wherein the trolley comprises;

said ground engaging carriage supporting a main frame, at least three castor wheels and said panel support platform which receives the panel lifting apparatus.

12. A panel lifting assembly according to claim 11 wherein the main frame includes hinges which allow rotation of the panel support platform.

13. A panel lifting assembly according to claim 12 wherein the panel support platform comprises a longitudinal beam and at least two transverse arms.

14. A panel lifting assembly according to claim 13 wherein the longitudinal beam is telescopically extendable.

15. A panel lifting trolley comprising a ground engaging carriage, a substantially upright mainframe, a panel support platform connected to the mainframe and capable of being tilted;

wherein the panel support platform has thereon a saddle for detachably receiving a panel lifting apparatus on the support platform;

wherein further the panel lifting apparatus comprises:

a primary support member, a wedge-shaped plate extending from the primary support member which engages the saddle, thereby providing the detachable attachment to the trolley, a clamp for gripping engagement with a panel to be lifted, and control means for actuating the clamp via a cable linking the clamp and the control means;

wherein when a panel is to be lifted from a position off the trolley and onto the trolley, the clamp is brought into engagement with the panel and the control means actuated to draw the panel onto the trolley enabling support and carriage thereof.

16. A panel lifting trolley according to claim 15 wherein the trolley includes hinges which allow rotation of the panel support platform.

17. A panel lifting trolley according to claim 16 wherein the panel support platform comprises a longitudinal beam and at least two transverse arms.

18. A panel lifting trolley according to claim 17 wherein the longitudinal beam is telescopically extendable.

19. A panel lifting trolley according to claim 18 wherein the ground engaging carriage comprises two spaced apart legs each of which terminate in a transverse castor support beam.

* * * * *